US006209242B1

(12) United States Patent
Marshall

(10) Patent No.: US 6,209,242 B1
(45) Date of Patent: Apr. 3, 2001

(54) PIEZOELECTRIC ROTATING DISPLAY

(76) Inventor: Roger Scott Marshall, 19 Inglesid La., Liverpool, NY (US) 13090

( * ) Notice: Subject to any disclaimer, the term of this patent is extended or adjusted under 35 U.S.C. 154(b) by 0 days.

(21) Appl. No.: 08/823,476

(22) Filed: Mar. 25, 1997

Related U.S. Application Data

(60) Provisional application No. 60/014,163, filed on Mar. 27, 1996.

(51) Int. Cl.[7] ..... G09F 19/02

(52) U.S. Cl. ..... 40/414; 206/6.1; 206/566; 40/429; 40/430; 40/456

(58) Field of Search ..... 40/414, 429, 430, 40/456, 473; 248/316.7, 176; 206/6.1, 566

(56) References Cited

U.S. PATENT DOCUMENTS

| | | | | |
|---|---|---|---|---|
| 1,945,072 | | 1/1934 | Qyigley . | |
| 4,755,705 | * | 7/1988 | Holum | 310/328 |
| 4,764,850 | | 8/1988 | Albanese . | |
| 4,970,810 | | 11/1990 | Liou . | |
| 4,998,364 | | 3/1991 | Sengstaken . | |
| 5,345,153 | * | 9/1994 | Vaught | 318/4 |
| 5,367,808 | | 11/1994 | Liebman et al. . | |

* cited by examiner

*Primary Examiner*—Cassandra H. Davis

(74) *Attorney, Agent, or Firm*—Harter, Secrest & Emery LLP; Brian B. Shaw, Esq.; Stephen B. Salai, Esq.

(57) ABSTRACT

A motorized display using piezoelectricity to impart motion to a jewelry item or other items is disclosed. A quartz movement, otherwise used for rotating hands of a clock, is preferably used to rotate the display. In a preferred embodiment, a housing which has a drive aperture encloses the piezoelectric motor and a battery. A drive shaft, which rotates when the motor is powered, passes through the drive aperture of the housing. A holder for removably but securely holding a jewelry item or other items is positioned on the end of the drive shaft exterior to the housing and may be removable from the drive shaft. The holder may be a ring holder, a watch holder, a broach holder, etc., or may even be an entire jewelry box. The rotation of the drive shaft may be either stepped or continuous and a kit may be provided to the user which includes both types of motors. In one embodiment of the device, the housing may include a light port optically aligned with a photosensitive switch disposed in the housing and operably connected to the piezoelectric motor to permit operation of the motor in response to an ambient light. In another embodiment, the housing may be provided with a cover operably connected to a switch which turns the power off when the cover is closed and turns the power on when the cover is open. In yet another embodiment, the motor may be positioned below a flexible bag filled with fluid. Disturbance arms attached to the drive shaft of the motor create waves or ripples in the fluid and cause a jewelry item placed on top of the bag to move.

9 Claims, 5 Drawing Sheets

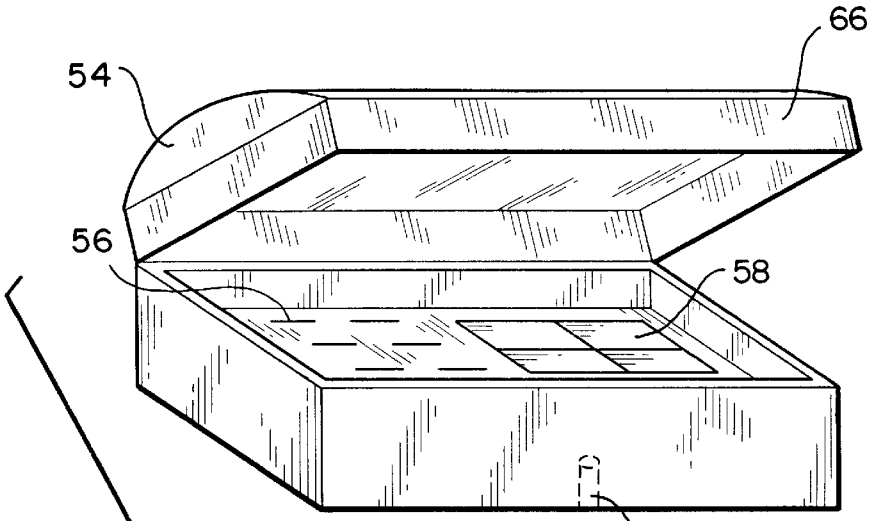
FIG. 7A
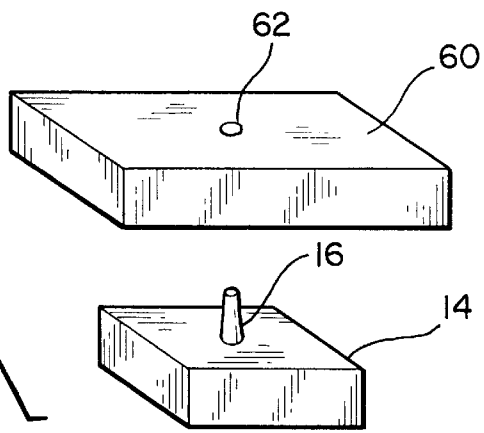
FIG. 8
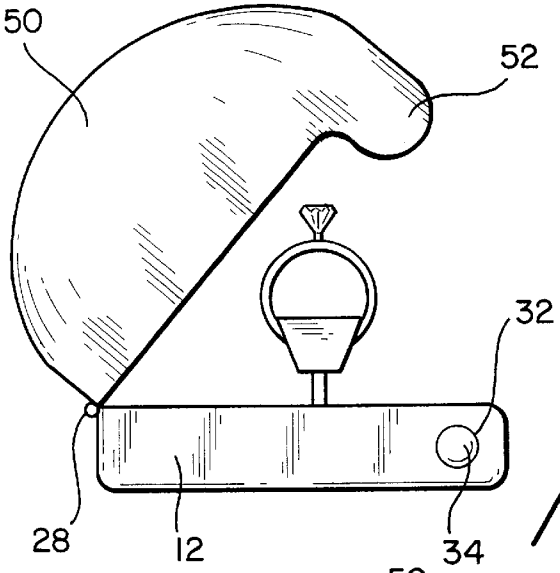
FIG. 7B
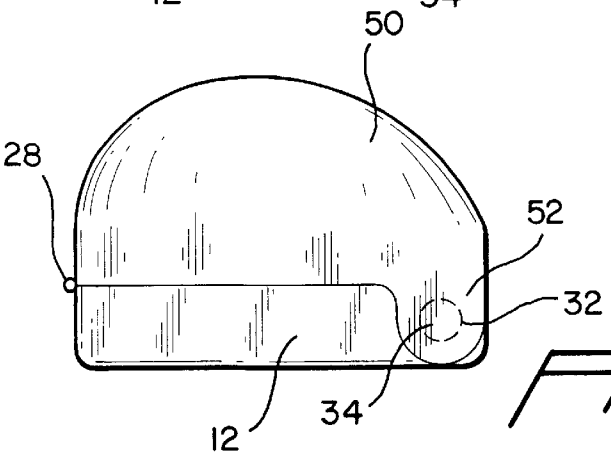

PIEZOELECTRIC ROTATING DISPLAY

This application claim benefit to Provisional application Ser. No. 60/014,163, filed Mar. 27, 1996.

FIELD OF THE INVENTION

The present invention relates generally to a motorized jewelry display for rings, broaches, pendants, watches, bracelets, earrings, or any jewelry item or other item that would benefit from movement, and more particularly relates to a display using piezoelectricity supplied by a quartz motor powered by a small battery to rotate a drive shaft which supports an item holder.

BACKGROUND OF THE INVENTION

In jewelry stores or counters, jewelry is commonly displayed in the storefront windows or under glass for customer viewing to determine if they would like to take a closer look at a certain piece. The store owner benefits from having the jewelry displayed in an attractive fashion to catch the eyes of potential customers, as well as enhance the beauty of the products. Jewelry, therefore, such as rings, broaches, pendants, watches, bracelets, earrings, and the like are typically displayed on velvet or satin covered stands. The velvet, satin, or other material chosen to surround the products are typically rich in color, such as red or royal blue. The store owner may resort to mirrors positioned below or about the jewelry in an attempt to further enhance the beauty of glimmering jewelry and attract potential customers.

In the past, objects which rotate on a stand have been devised for various reasons. U.S. Pat. No. 1,945,072 to Quigley discloses a display apparatus for displaying and rotating packaged goods which are exteriorly decorated with advertising. The apparatus requires an electrical outlet for operation, a set of mirrors, and a flashlight apparatus. U.S. Pat. No. 4,764,850 to Albanese discloses a solar-powered display device for displaying a multi-faceted crystal. U.S. Pat. No. 4,970,810 to Liou discloses an electronic flower set with intermittent movement. The apparatus must be turned on and off and movement of the flower requires the receipt of a sound signal. U.S. Pat. No. 4,998,364 to Sengstaken discloses a miniature airplane and curved banner for spinning about the top of a housing. U.S. Pat. No. 5,367,808 to Liebman et al discloses a sign turner with a low power consumption controller. The devices disclosed in these patents are either too large, complex, costly, and/or unattractive for use as a jewelry display. Furthermore, none of the disclosed devices take advantage of piezoelectric motors which eliminates many of the undesirable qualities of the prior art displays.

Thus, there is a need for an improved jewelry display which can better capture the attention of potential customers. There is further a need for a rotating display capable of displaying jewelry. There is further a need for a rotating jewelry display which can be manufactured and utilized at a low cost in order to employ a multiplicity of such displays in a jewelry case or window. There is further a need for a rotating display which is small enough to be adapted for use in a jewelry case or window. There is further a need for a rotating display which takes advantage of piezoelectricity and which can be aesthetically pleasing in a jewelry case or window (solar cell panels are not aesthetically pleasing enough for the desired uses). There is further a need for a rotating jewelry display which can accommodate various jewelry items. There is further a need for a rotating display which can rotate removable jewelry or other items which has a holder that does not leave residue on the items. There is further a need or a rotating jewelry display which can move a drive shaft in a stepped rotation for displaying rings or in a continuous sweeping rotation for displaying other items of jewelry. There is further a need for a rotating display which can rotate a variety of merchandise items economically and efficiently.

SUMMARY OF THE INVENTION

Therefore, it is a primary object of this invention to improve the quality and attractiveness of jewelry display cases and store windows by imparting motion to pieces of jewelry.

It is further an object of this invention to provide a rotating display capable of supporting jewelry items at a low cost to the store owner and in a size and shape which does not detract from the jewelry and which does not take anymore room within existing jewelry cases and store windows than do present displays.

It is further an object of this invention to provide a rotating jewelry display motorized by piezoelectricity.

It is further an object of this invention to provide a rotating display which has a holder which can removably, securely, and cleanly hold an item and which does not scratch, leave residue on, or otherwise harm the item being displayed.

It is further an object of this invention to provide a rotating display which may incorporate a photosensitive switch for permitting operation of the rotating display in response to an ambient light.

It is further an object of this invention to provide a rotating jewelry display capable of being passed on to the customer with a cover capable of opening and closing.

It is further an object of this invention to provide a rotating jewelry display capable of supporting various pieces of jewelry and capable of rotating in a stepped fashion or a continuous sweeping fashion dependent on the piece of jewelry being displayed. It is further an object of this invention to indicate to the user which method of rotation the display will move.

It is further an object of this invention to provide a piezoelectric rotating display for displaying other items of merchandise.

It is further an object of this invention, in another embodiment, to impart motion to a piece of jewelry by placing a motor underneath a bag of fluid upon which a piece of jewelry will sit.

The foregoing objectives of the present invention are accomplished by a motorized jewelry display used for displaying rings, broaches, pendants, watches, bracelets, earrings or any jewelry item or other item that would benefit from movement in trade. Piezoelectricity is preferably used to create the movement. When certain crystals, such as quartz, are compressed in certain directions, an electric polarization (and a corresponding voltage called piezoelectricity) is induced due to the displacement of charged atoms along the same axis. The piezoelectric effect is used in many applications around the world such as the quartz oscillator for timepieces. In a quartz oscillator, the extremely regular mechanical vibrations of a quartz crystal control corresponding electrical oscillations in a coupled electronic circuit, in a way analogous to the regulation of a mechanical clock by the oscillation of its pendulum.

The main benefit of piezoelectricity is the very low power requirement needed to create movement. Small batteries such as one "AA" battery can power a movement 24 hours a day for over a year. In one embodiment, the design may incorporate a photocell to detect light which allows the movement to shut-off if no light is detected in the environment. For example, if the motorized jewelry display was in a place of business where the hours of operation were 12 hours a day (lights in the room turned on) and 12 hours a day closed (lights in the room turned off) then the life of the battery could effectively double.

Another benefit of using piezoelectricity is low cost. Using inexpensive quartz movements allows the cost structure of the motorized jewelry displays to be very competitive against other displays that use movement. The main demand of using quartz as the material to create piezoelectricity is keeping time accurately and inexpensively because quartz has a property of generating extremely regular mechanical vibrations. This demand has allowed the cost structure of quartz movements to drop. Motorized jewelry displays may not always require the accuracy of movement that timepieces require but the present invention may effectively and economically use quartz movements because of the low cost structure. It is possible to substitute quartz for another crystal or ceramic material once the market for motorized jewelry displays becomes big enough. In addition to the low cost structure, the accuracy of movement created by the quartz oscillators may be taken advantage of in motorized jewelry displays by synchronizing displays which are placed in the same vicinity as one another for creating a dramatic effect.

In a preferred embodiment, the display starts with a quartz movement that requires a battery such as a "AA" size. If the display is intended to rotate heavier items, a larger quartz motor powered by, for example, a "C" size battery may be required. The quartz movement may then be covered with an aesthetically pleasing cover. The covers used may be made from the top of existing jewelry boxes. A hole is provided through the center of the cover to allow the drive shaft to protrude through the top. A washer and nut may then be screwed on the drive shaft to secure the movement to the cover. Alternatively, the cover may be made by injection molded plastic. The molded covers can be provided with tabs which snap onto indents provided in existing clock quartz motors, which reduces labor costs.

A small hole may also be provided on the side of the cover to allow the mounting of a photocell. The photocell may be attached to a 3 piece sandwich shaped like a penny. The outer 2 pieces are conductive with the center piece being non conductive. This "penny" is placed between one end of the battery terminal and one end of the battery. As light is detected the display turns. If the user needs to stop movement, he or she may simply pick up the display, covering the photocell with a finger, and the display stops. In addition, and advantageously, when the lights go out in the room, such as at closing, the display stops. Alternatively, a cover may be attached to the display such that a portion of the cover covers the photocell when the cover is in a closed position.

This invention allows for different display attachments to be used on the main base of the display. For example a ring holder can be attached by placing the ring holder down on the drive shaft with a person's hand using slight downward pressure. A ring is then placed in the ring holder. The ring holder itself may be fabricated from low density polyurethane or from aluminum with a cloth covering, then attaching a small snap cap to the base of the ring holder. Part of the ring holder may be exposed for explanation purposes as may be the nut and washer securing the cover. If the user would like to use a different display attachment for the base, he or she may simply pull the ring holder off with slight upward pressure by hand. Then the user can, for example, snap on a broach display attachment. A broach attachment may also be made from aluminum with cloth attached. If a larger ring is needed for display then a larger ring holder can be snapped on. Alternatively, a specific holder may be permanently attached to the base or a specially designed holder, such as a ring holder, can be made to accommodate all sizes of the jewelry item, such a holder which fits all sizes of rings. Holders to hold earrings, figurines, pens, and watches, as well as other holders, also form part of this invention. The holders used are adapted to securely, cleanly, and removably hold an item without damaging or leaving residue on the item. The holders may be attached to the drive shaft in a number of other ways, such as by screw threads, gravity, snap-fit, or friction fit connections.

Different types of movement may be imparted to different types of jewelry, as is deemed appropriate. For example, a continuous quartz movement is ideally used for broaches and pendants because of the elegant appeal that it displays in its sweeping movement while smaller more angular jewelry pieces benefit from stepper movements (in which each step is typically a second) because light reflection is maximized given the smaller radius of the piece. In a preferred embodiment, the color of the housing of the display indicates to the store owner or user the type of movement that will be imparted to the jewelry. The continuous and stepper movements may be interchangeable to the bases just as the display attachments are to the base. This design allows many variations to the way a piece of jewelry or other item can be displayed.

In an alternate embodiment, a complete jewelry box with a quartz movement may be placed right below the box with a hole drilled in the middle for the drive shaft. The box may employ non-stop movement until the battery is removed. If a photocell is employed, the motor stops when the box is closed and when the box is opened the photocell detects light and the display turns.

Alternatively, a lever which connects the battery to the battery terminal when the box is opened, but disconnects when the box is closed, may be used.

In another alternate embodiment, a quartz movement is placed underneath a small bag of fluid upon which a jewelry item rests. The quartz movement imparts vibrations to the bag which in turn moves the jewelry item in a wavelike fashion. The fluid bag may be held within a box-like housing and a strap or other holder may be used to retain the jewelry item on the bag.

These and other objects and features of the present invention will be apparent from the following description taken in conjunction with the accompanying drawings, in which like reference characters designate the same or similar parts throughout the figures thereof.

BRIEF DESCRIPTION OF THE DRAWINGS

FIG. 7A shows a side view of the rotating display device of FIG. 4 used with a cover and FIG. 7B shows a side view of the rotating display device of FIG. 7A with the cover closed.

FIG. 8 shows a front perspective view of a rotating display in another embodiment of the invention using an entire jewelry box as a holder.

DETAILED DESCRIPTION OF THE INVENTION

Figure 2:
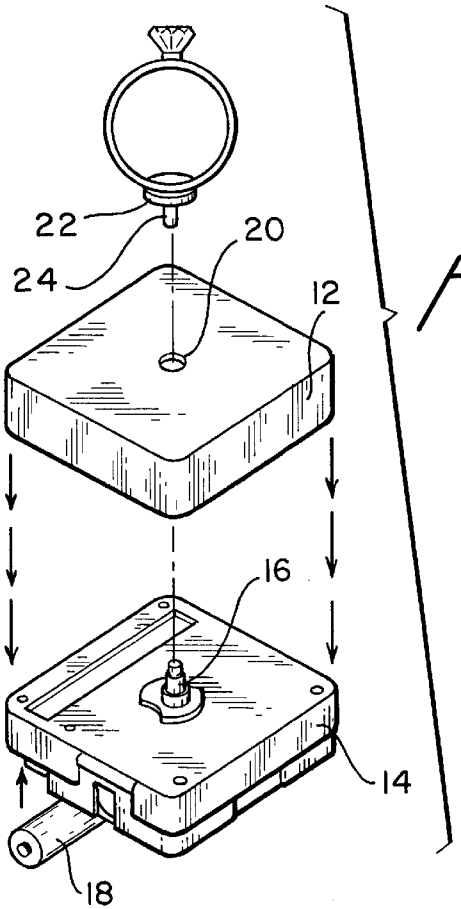
FIG. 2 shows an exploded view of the rotating display device of FIG. 1.
Figure 1:
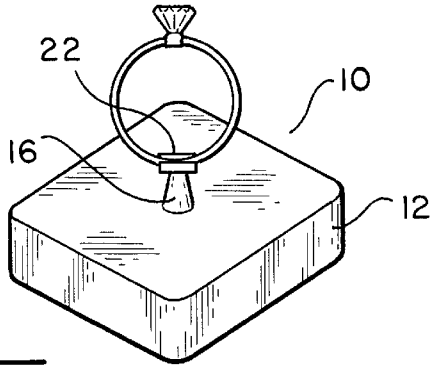
FIG. 1 shows a side perspective view of an assembled rotating display device in one embodiment of the present invention.

As shown in FIGS. 1 and 2, a rotating display device 10 comprises a housing 12 which surrounds a piezoelectric motor 14. The housing 12 may be made from the top of existing jewelry boxes and is preferably aesthetically pleasing in color and texture. The housing 12 is preferably solid and opaque, with substantially the entire covering made from a single material, so as not to detract from the beauty of the item being displayed. A hole 20 is drilled, punched, or molded in a central area of the top surface of the housing 12. A drive train 16 extends from the piezoelectric motor 14 and rotates when the motor 14 is powered by a battery 18. The housing 12 may snap onto or be glued to the motor 14 or a bottom cover (not shown) may be used to retain the motor 14 within the housing 12. Alternatively, a washer and nut may be placed over the drive train 16 to secure the housing 12 to the motor 14.

When assembled, as shown in FIG. 1, the drive train 16 passes through the hole 20 of the housing 12 so as to be disposed exteriorly of the housing 12. A holder 22 is securely attached, preferably removably, to the drive train 16. In a preferred embodiment, the drive train 16 is hollow and dimensioned to accept a stem 24 of the holder 22. The connection is preferably secure, and made so by either a friction fit, snap fit, screw threads, or other similar removable securement means. The hollow recess in the drive train 16 may be one originally intended for mating with the stems of hands of a clock. In another embodiment, the stem 24 of the holder 22 may be hollow so as to wrap around the drive train 16 of the motor 14.

The holder 22 is adapted to securely, cleanly, and preferably removably, hold a jewelry item, such as ring 11. Various holders could be provided, as will be discussed, so that various items of jewelry, or other items of merchandise, can be held to the display device 10.

The piezoelectric motor 14 is preferably a crystal quartz oscillator designed for standard wall clocks, and may be a 32.768 kHz crystal quartz oscillator available from Seiko Corporation. The driving system is preferably self-start, that is, it begins and continues operation whenever a battery is inserted. The battery used in conjunction with such a motor is a AA size and has a life of approximately one year under non-stop use. The accuracy of these motors allows for synchronization of multiple displays. Of course, if heavier items are being displayed, a larger motor may be necessary. Larger crystal quartz oscillators are available which are otherwise used for rotating larger sized clock hands.

The display device 10 may be used with a motor 14 having a driving system with a step motor drive or a continuous motor drive. A motor with a step motor drive is ideal for use with the display device 10 when a jewelry item such as a ring 11 is displayed. The stepped movement allows light to reflect in short time periods off the facets of the stone of the ring. A motor with a continuous motor drive is ideal for use with the display device 10 when a jewelry item such as a broach is displayed due to the elegance of the continuous sweeping movement. Of course, either movement could be used for any jewelry item and may be selected by the taste of the retailer or consumer. In one embodiment, a housing 12 used with a motor 14 having a continuous motor drive may be in one color and a housing 12 used with a motor 14 having a step motor drive may be in another color, to assist a retailer in determining which type of display device to use. Also, the motors 14 may be interchangeable with the housings 12 for flexibility in use. A kit may be provided to a retailer having housings of different colors, motors with different drive systems, and holders for holding various jewelry or other items to assist the retailer in setting up a display using rotating display devices.

Figure 3:
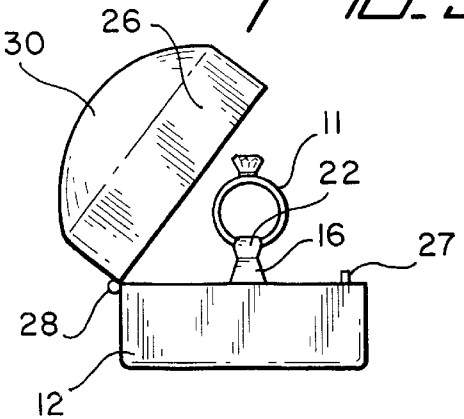
FIG. 3 shows a side view of the rotating display device of FIG. 1 used with a cover.

The display device 10 shown in FIGS. 1 and 2 is designed for use in a retail store environment, however, it may also be purchased by a customer. Turning to FIG. 3, a pivotally attached cover 26 may be attached by a hinge 28 to the housing 12 of the display device 10. The cover 26 may have a rounded top 30 in order to allow the cover 26 to pivot down and over the ring 11. This embodiment is ideal for the end user who purchases the jewelry item as a gift. When the receiver of the gift opens the cover 26, the jewelry item 11 is rotating above and relative to the housing 12. Thus, the receiver is not only surprised by the gift, but is also impressed by the beauty of its presentation.

The display device 10 of FIGS. 1–3 will rotate a jewelry item in a non-stop fashion so long as the battery 18 is in place in the motor 14. Although a separate on-off switch could be used, the device is designed to be as convenient and maintenance free as possible so that a retailer using several of the display devices in a store window or jewelry display case does not have to turn all of the devices off at the end of the day and on again at the beginning of the day. Using an on-off switch could double the lifespan of the battery, but most retailers would probably prefer not to deal with the hassle of turning the devices on and off every day. Nonetheless, a moveable switch 27 may be employed, as shown in FIG. 3, which electrically connects one end of the battery 18 to a battery terminal in an "up" position when the cover 26 is in an open position and which electrically disconnects one end of the battery 18 to the battery terminal in a "down" position when the cover 26 is in a closed position and pressing down on the moveable switch 27.

Turning now to FIGS. 4–7, a light sensitive switch in combination with the rotating display device is shown in which the drive train 16, and thus the holder 22 and the jewelry item 11, only rotate in the presence of light. If a retail store is closed with lights off 12 hours a day, then the battery life of the battery 18 in the motor 14 would double, as from one year to two years. Although the lifespan of the battery is expanded, the cost of including a light sensitive switch is almost the same as the cost of a battery. Thus, this embodiment is designed for the retailer who intends to use a large quantity of display devices over a long period of time, which would justify the initial increased cost. Another situation which may advantageously employ the light sensitive switch is when the display device is used in a store which has night security with motion detectors which might set off an alarm in response to the movement of a turning display.

Figure 4:
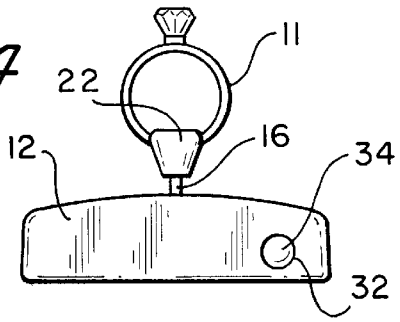
FIG. 4 shows a side view of a rotating display device in another embodiment of the invention having a light sensitive switch.
Figure 5:
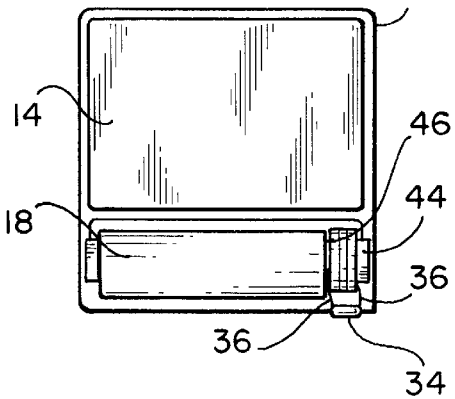
FIG. 5 shows a bottom view of the rotating display device of FIG. 4.
Figure 6:
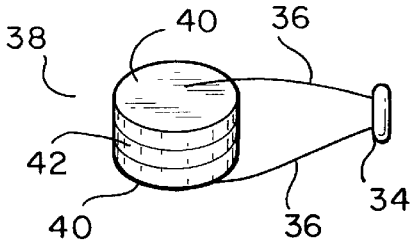
FIG. 6 shows the photocell used in the rotating display device of FIG. 4.

As shown in FIG. 4, a light port 32 is molded, drilled into or punched out of the housing 12. Visible through the light port 32 is a photocell 34. The size of the light port 32 and the photocell 34 is small enough so as not to detract from the beauty of the display, and may be placed on the side of the housing as shown. As shown in FIGS. 5 and 6, the photocell 34 may be connected via conductive wires 36 to a penny-shaped sandwich 38 comprising two outer conductive layers 40 and an inner non-conductive layer 42. The sandwich 38 is placed between one end of a battery terminal 44 and one end 46 of the battery 18. When light is detected by photocell 34, current may pass from the battery 18 through a conductive layer 40, a conductive wire 36, photocell 34, a second conductive wire 36, a second conductive layer 40, and battery terminal 44 to power the motor 14. When no light is detected by photocell 34, current cannot pass through photocell 34. Because current is also not carried by non-conductive layer 42, there are no available paths for current to flow between one end 46 of battery 18 and battery terminal 44. Thus, when no light is detected by photocell 34, the motor 14 does not rotate the drive train 16 and thus the display 10 is stopped. Thus, if a customer or retailer wishes to examine a jewelry or other item 11 while it is stationary, he or she need only block the light port 32 with a finger while holding the display 10.

Turning now to FIGS. 7A and 7B, a rotating display device having a photocell 34 may be used in combination with a pivoting cover 50 attached to housing 12 by hinge 28. Again, the covered version of the display is ideal for the end user wishing to present the item 11 as a gift. Of course, other uses are fully within the scope of this invention. The cover 50 is different from the cover 26 shown in FIG. 3 in that the cover 50 is provided with a protruding nub 52 which overlaps a portion of the housing 12 enough to hide the light port 32. Thus, when the cover 50 is in a closed position as shown in FIG. 7B, the light port 32 is hidden and the photocell 34 is blocked from receiving light so that the item 11 is not rotating inside the closed box. When a user opens the cover 50 to the open position shown in FIG. 7A, the light port 32 is again exposed to light so that the display can again rotate an item 11 above the drive shaft 16. Although nub 52 is shown for covering the light port 32, any other covering attached to the cover 50 which hides the light port 32 when the cover 50 is in a closed position and reveals the light port 32 when the cover 50 is in an open position may be used.

Turning now to FIGS. 8 and 9A–9J, a variety of holders may be utilized with the rotating display device of the present invention. As shown in FIG. 8, an entire jewelry box 54 could be used as a holder. The jewelry box 54 is preferably adapted to hold a plurality of jewelry items such as rings, pins, and broaches, and may include ring slots 56 and containers 58. The jewelry box 54 may be rotated about a central point of the box 54 to display a variety of jewelry items at the same time. A drive train 16 attached to a motor 14 rotates when the motor 14 is powered by a battery 18 (not shown). The motor 14 used for rotating the jewelry box is preferably somewhat larger than the motor used for rotating single items of jewelry or other merchandise, but it is still preferably a quartz movement such as that used for rotating large hands of a clock. The motor 14 is covered by a housing 60 which is preferably wide enough to provide a steady base for the jewelry box 54 to rotate above without tipping over. The housing 60 is provided with a hole 62 for the drive train 16 to pass. The drive train 16 is then preferably fitted into a correspondingly shaped recess 64. The drive train 16 and recess 64 are provided with a friction fit such that rotation of the drive train 16 causes a corresponding rotation of the jewelry box 54. The jewelry box 54 may be provided with a cover 66, and, if desired, could be fitted with a photocell as previously described which is hidden when the cover 66 is closed.

Figure 9A:
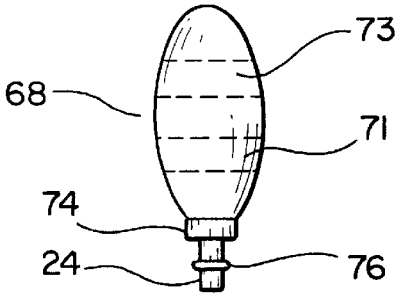
FIG. 9A shows a a front plan view of the ring holder for the rotating display device of the present invention.
Figure 9B:
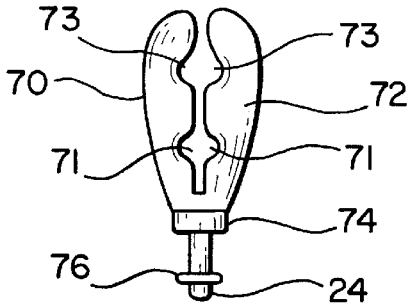
FIG. 9B shows a side plan view of the ring holder of FIG. 9A.

FIGS. 9A and 9B show a ring holder 68 having two sturdy leaves 70 and 72 spaced a small distance apart and connected at a bottom section by a connector 74. The leaves 70 and 72 may be made from molded low density polyurethane or from another sturdy, flexible, and somewhat resilient material such as aluminum covered with an attractive cloth. The connector 74 also connects the ring holder 68 to a stem 24 which is used to connect the holder 68 to the drive train 16. For exemplary purposes only, the stem 24 may be provided with a circumferential protrusion 76 used to retain the stem 24 within the drive train 16. The drive train 16 may be provided with a corresponding circumferential groove (not shown) for retaining the stem 24. Although the leaves 70 and 72 could have flat inner faces, they are preferably each provided with grooves 71 and 73 as shown in phantom in FIG. 9A and shown in cross-section in FIG. 9B. In use, a ring with a small band width may be inserted between the leaves 70 and 72 and pushed towards the connector 74 until it "snaps" between the grooves 73 and is retained therein by friction. A ring with a larger band width may be inserted between the leaves 70 and 72 and pushed towards the connector 74 until it "snaps" between the grooves 71 and is retained therein by friction.

Figure 9C:
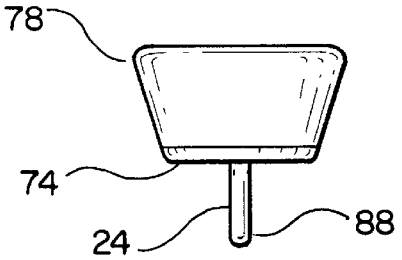
FIG. 9C shows a front plan view of an alternate embodiment of a ring holder for rotating display device of the present invention.
Figure 9D:
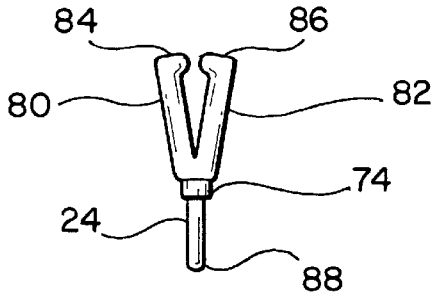
FIG. 9D shows a side plan view of the ring holder of FIG. 9C.

FIGS. 9C and 9D show a ring holder 78 having two sturdy leaves 80 and 82 which are biased towards each other. A top section 84 of leaf 80 and a top section 86 of leaf 82 may be bent towards the opposing leaf to retain a ring between the leaves. The ring holder 78 is thus designed to hold rings having a very larger bandwidth, such as some men's rings and school class rings. The leaves 80 and 82 are connected at a bottom section by connector 74 which connects the ring holder 78 to a stem 24. By example only, the stem 24 may be provided with threads 88 (female or male) which engage with threads (not shown) inside the drive train 16. In use, a ring may be inserted between the leaves 80 and 82 and retained therein by friction and by the bent top sections 84 and 86.

Figure 9E:
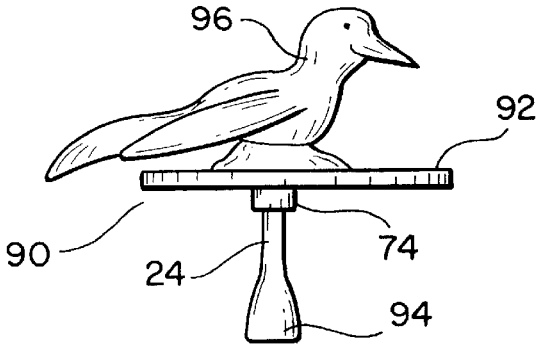
FIG. 9E shows a side plan view of a merchandise item holder for the rotating display device of the present invention.
Figure 9F:
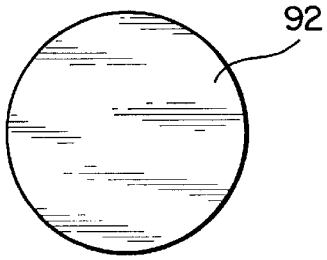
FIG. 9F shows a top plan view of the merchandise item holder of FIG. 9E.

FIGS. 9E and 9F show a merchandise item holder 90 having a plate 92. Although the plate 92 is shown as round, other shapes such as oval, square, triangular, rectangular, and other polygonal shapes could be used. Also, although the plate 92 is shown as flat, the plate 92 could also be provided with a multi-level surface. The plate 92 is connected by a connector 74 to a stem 24 which connects the holder 90 to a drive train 16. By example only, the stem 24 may be provided with a recess 94 which is adapted to surround the exterior of the drive train 16. The stem 24 may thus be retained on the drive train 16 by gravity, although the recess 94 and the exterior of the drive train 16 could be provided with corresponding grooves and protrusions or male and female threads to provide a more secure fit. The holder 90 is adapted to hold the irregularly shaped item 96 upon its plate 92. The item 96 could be a figurine as shown, or could be a jewelry item, miniature clock, computer chip, or any other item wishing to be displayed.

Figure 9G:
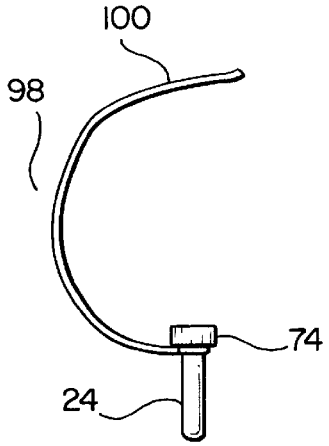
FIG. 9G shows a side plan view of a bendable holder for the rotating display device of the present invention.

FIG. 9G shows a holder 98 comprising a bendable wire 100 twisted at a bottom section about connector 74 which connects the wire 100 to a stem 24. A top section of bendable wire 100 may be bent about an object to be displayed such as a pen. Depending on the thickness of the wire, the holder 98 is adapted to hold irregular shaped items within a certain weight class. The holder 98 may be used when it is desired to make an object appear as if it were floating in the air. By example only, the stem 24 is shown as a peg which may be inserted within a recess of the drive train 16 and retained therein by friction and/or gravity.

Figure 9H:
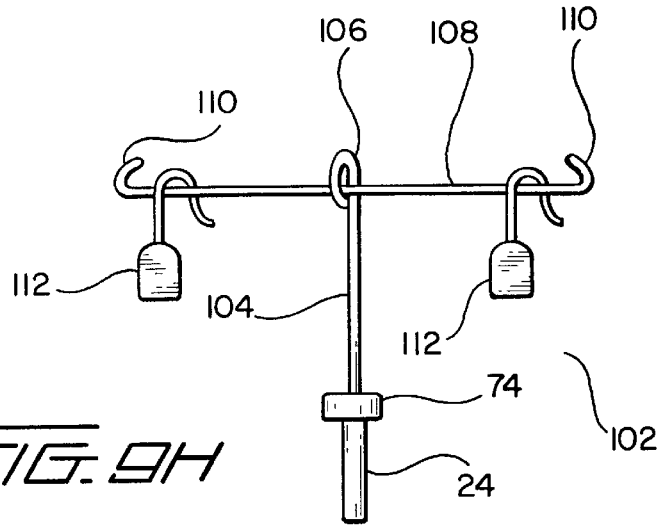
FIG. 9H shows a front plan view of a pendulum type holder for the rotating display device of the present invention.

FIG. 9H shows a pendulum type holder 102 comprising a center bar 104 having a hook 106. Seated within the hook 106 is a cross bar 108 which is provided with a hook 110 on each end. With the cross bar 108 balancing on the hook 106, two equally weighted items 112 may be hung on either end of the cross bar 108. The hooks 110 prevent the items 112 from sliding off the holder 102. The center bar 104 may be attached by a connector 74 to a stem 24 for connecting to a drive train 16. The holder 102 is adapted for holding hook-type earrings, fishing lures, etc.

Figure 9I:
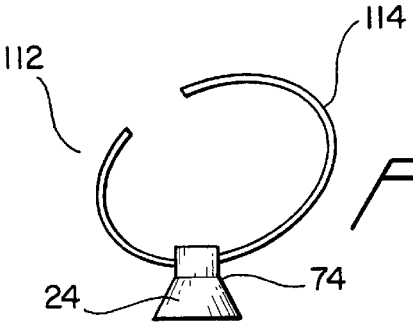
FIG. 9I shows a side plan view of a watch holder for the rotatable display device of the present invention.

FIG. 9I shows a watch holder 112 having a watch holding "loop" 114 which may be attached to a connector 74 for connecting to a stem 24 for connecting to a drive train 16. The connector 74 as shown in FIG. 9J may be C-shaped to enable a watch to be wrapped around the loop 114.

Figure 9J:
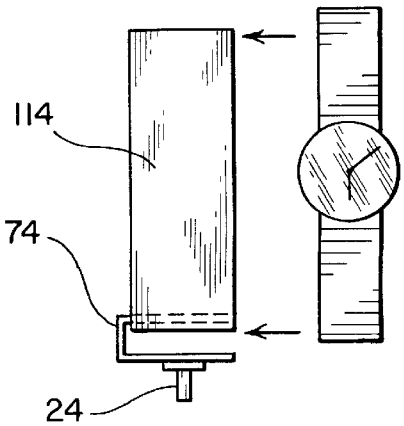
FIG. 9J shows a front plan view of the wacth holder of FIG. 9I.

Thus, as is seen from FIGS. 8–9J, a variety of holders may be employed with the piezoelectric rotating display device of the present invention. Although specific examples of holders have been shown, other types of holders may be used, so long as a stem 24 is provided which can connect the holder to the drive train 16. Also, although a variety of stems 24 have been shown, typical crystal quartz movements provide a snap-fit connection between the movement and its clock hands, therefore, the preferred stem 24 is designed to accommodate the snap-fit connection with a quartz movement designed for clocks.

Figure 11:
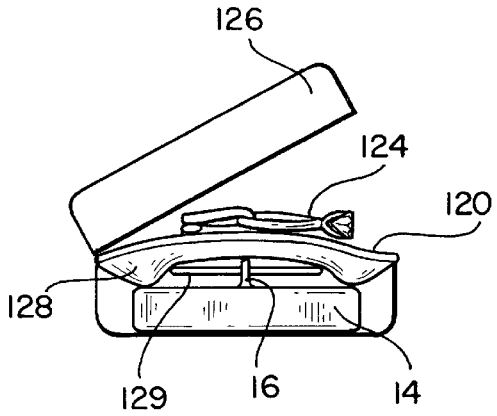
FIG. 11 shows a side cross-sectional view of the moving display device of FIG. 10 and holding a ring.
Figure 12:
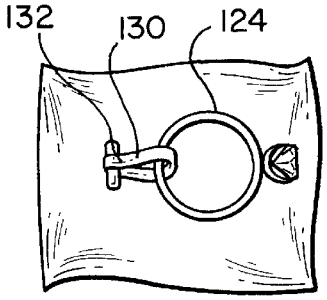
FIG. 12 shows a top plan view of the moving display device of FIG. 10 holding a ring.
Figure 10:
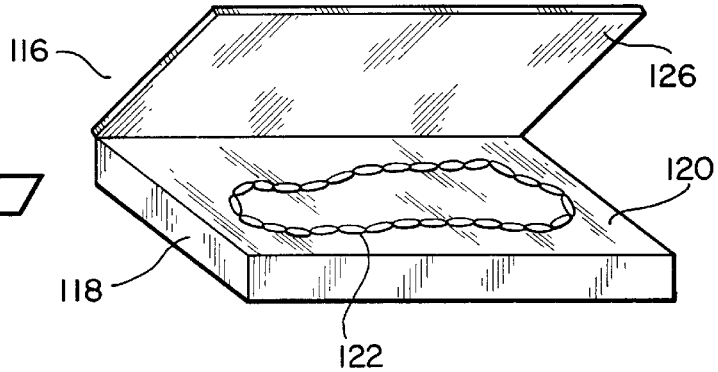
FIG. 10 shows a front perspective view of a moving display device according to another embodiment of the present invention.

Turning now to FIGS. 10–12, another embodiment of a moving display device is shown. The moving display device 116 comprises a motor 14 as previously described and comprises a housing 118. The holder for holding the item to be displayed, however, is not attached to a stem 24 for rotation as in the previous embodiments. In this embodiment, a fluid bag 128 rests upon the motor 14. The fluid bag 128 may be covered by an aesthetically pleasing cover 120 upon which an item to be displayed (e.g., necklace 122 or ring 124) rests. Arms or other disturbance device 129 may be attached to the drive shaft 16. The arms 129 may be the hands of a clock that are designed for attachment to the quartz movement. As the drive shaft 16 rotates, the arms 129 slide across the bottom of the fluid bag 128 disrupting the fluid contained therein. A "wave" or ripple is created in the bag 128 and an item sitting atop the bag 128 is thus moved as well. The fluid contained within the bag 128 could be water for creating very noticeable movement, gel for creating subtle movement, or other fluid. Water is presently the preferred fluid because it gets significant movement and is the most inexpensive choice. A cover 126 could be attached to the housing 118 if desired, such as for use by an end user. Although movement of the fluid bag 128 should be gentle enough so as not to shake an item off of its surface, a retaining strap 130, as shown in FIGS. 11 and 12, may be used to retain the item to be displayed in a central area of the display device 116. The retaining strap 130 may be a hook and loop type retaining means with hooks and loops on the strap 130 and a connecting strip 132, respectively.

Figure 13:
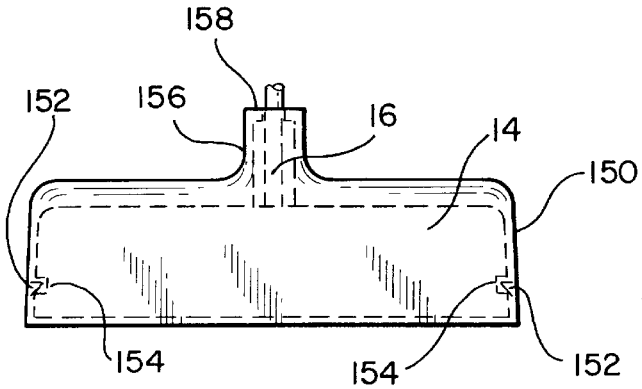
FIG. 13 shows a side view of an alternate embodiment of a housing for the rotating display device.

Turning now to FIG. 13, an alternate embodiment of a housing to be used in a rotating display device is shown. The housing 150 is preferably a one-piece plastic molded housing which covers the motor 14, shown in phantom. The housing 150 is preferably provided with two tabs 152 on an inner surface of the housing 150. The housing 150 is further preferably provided with a funnel-shaped extension 156 with a substantially circular opening 158 serving as the drive aperture. Of course, alternate shapes of the housing 150 may be molded as desired. In assembly, the housing 150 is placed over a motor 14 such that drive train 16 is introduced through opening 158. As the housing 150 is placed further over the motor 14, tabs 152 engage with indents 154 which are provided on existing quartz motors for clocks. Thus, the housing 150 is provided with a snap-fit connection with the motor 14. This embodiment allows for different colors to be used at no additional cost thus allowing for customized housings. Different textures, shapes, and tactile alphanumeric or pictorial symbols may also be included in the mold to further customize the housings. The labor cost is also low because as the mold comes off the press, a worker merely has to snap the motor into the mold and the display is ready to receive its chosen holder.

The embodiments of the present invention described above are to be regarded in all respects as merely illustrative and not restrictive. Accordingly, the present invention may be embodied in other specific forms without deviating from the spirits thereof. For example, the rotating display device could be used to display baseball cards, small advertising signs, photographs, holographic pictures, silverware, rare coins, shells, toys, computer chips, uncut stones, ball point pens, golf balls, fishing lures, etc. with holders designed to securely, and preferably removably, hold the item to the device for rotation. Such displays could be used in specialty shops, trade shows, museums, department stores, supermarkets, and even the home. The present invention is therefore to be limited only by the scope of the following appended claims.

What is claimed is:

1. A rotating display device, comprising:

(a) a housing having a drive aperture and a light port;

(b) a piezoelectric motor sized to be retained within the housing;

(c) a drive train connected to the piezoelectric motor, the drive train having a portion sized to pass through the drive aperture to be disposed exterior to the housing;

(d) a holder connected to the drive train exterior to the housing, the holder adapted to securely but removably hold a merchandise item; and, (e) a photosensitive switch disposed in the housing and optically aligned with the light port, the photosensitive switch operably connected to the piezoelectric motor to permit operation of the motor in response to an ambient light.

2. The display device of claim 1 wherein the holder is a broach holder.

3. The display device of claim 1 further comprising a cover movably connected to the housing between an open position and a closed position, the cover overlying the light port in the closed position.

4. The display device of claim 3, further comprising a switch which turns the piezoelectric motor on when the cover is in an open position and turns the piezoelectric motor off when the cover is in a closed position.

5. The display device of claim 1 further comprising a set of said holders, each holder removably attached to the drive train, the set of said holders including at least two jewelry holders shaped differently from each other and adapted to hold different items of jewelry.

6. The display device of claim 1 wherein the holder is a jewelry box adapted to hold a plurality of jewelry items.

7. The display device of claim 1 wherein the housing is provided with a plurality of tabs and the motor is provided with a plurality of indents which receive the tabs.

8. The display device of claim 7 wherein the housing is made from injection molded plastic.

9. A rotating display device, comprising:

(a) a housing having a drive aperture;

(b) a piezoelectric motor sized to be retained within the housing;

(c) a drive train connected to the piezoelectric motor, the drive train having a portion sized to pass through the drive aperture to be disposed exterior to the housing; and (d) a jewelry holder connected to the drive train exterior to the housing, the holder one of a clip and a bracket adapted to securely but removably hold a merchandise item a set of said jewelry holders each jewelry holder removably attached to the drive train, the set of said jewelry holders including at least two jewelry holders shaped differently from each other and adapted to hold different items of jewelry.

* * * * *